US006575627B2

(12) United States Patent
Huseman et al.

(10) Patent No.: US 6,575,627 B2
(45) Date of Patent: Jun. 10, 2003

(54) SELECTIVELY CLOSEABLE PLASTIC FILM BAG STRUCTURE

(76) Inventors: David C. Huseman, 2028 Valley Ct., Brentwood, TN (US) 37027; George Pappas, 2102 Forest Park Blvd., Fort Wayne, IN (US) 46805

( * ) Notice: Subject to any disclaimer, the term of this patent is extended or adjusted under 35 U.S.C. 154(b) by 100 days.

(21) Appl. No.: 09/973,134

(22) Filed: Oct. 9, 2001

(65) Prior Publication Data

US 2003/0068101 A1 Apr. 10, 2003

(51) Int. Cl.[7] ..... B65D 30/22
(52) U.S. Cl. ..... 383/38; 383/37; 383/93
(58) Field of Search ..... 383/38, 37, 93, 383/95; 206/558

(56) References Cited

U.S. PATENT DOCUMENTS

| | | | | | |
|---|---|---|---|---|---|
| 2,344,369 | A | * | 3/1944 | Salfisberg | 383/109 |
| 3,469,768 | A | * | 9/1969 | Repko | 383/207 |
| 4,201,031 | A | * | 5/1980 | Wiles | 53/455 |
| 4,759,643 | A | * | 7/1988 | Canno | 383/84 |
| 4,932,791 | A | | 6/1990 | Vetter | |
| 4,993,844 | A | * | 2/1991 | Robinson et al. | 383/38 |
| 5,044,772 | A | | 9/1991 | Larson | |
| 5,056,930 | A | | 10/1991 | Mestetsky | |
| 5,102,234 | A | | 4/1992 | Levy | |
| 5,103,979 | A | | 4/1992 | Hustad | |
| 5,108,194 | A | | 4/1992 | Raden | |
| RE34,117 | E | | 10/1992 | Martin et al. | |
| 5,352,041 | A | | 10/1994 | Fullerton et al. | |
| 5,533,624 | A | * | 7/1996 | Soderholm et al. | 206/524.3 |
| 5,711,751 | A | | 1/1998 | Harmanoglu | |
| 6,012,844 | A | | 1/2000 | Huseman et al. | |
| 6,244,748 | B1 | * | 6/2001 | Kasai et al. | 383/203 |

* cited by examiner

*Primary Examiner*—Stephen P. Garbe
(74) *Attorney, Agent, or Firm*—George Pappas

(57) ABSTRACT

A selectively closeable plastic film bag structure includes front, middle and rear panels forming a first bag between the front and middle panels and a second bag between the middle and rear panels. A first adhesive strip between the middle and rear panels extends between terminal ends at the second bag side edges. The front and rear panels extend above the middle panel and a second adhesive strip between the front and rear panels extends between terminal ends at the first bag side edges. A release liner is provided over the adhesive strips and retaining the bags open for placing product therein. By removing the release liner, the first bag is closed with the adhesive strip between the front and rear panels and the second bag is closed with the adhesive strip between the middle and rear panels.

34 Claims, 6 Drawing Sheets

SELECTIVELY CLOSEABLE PLASTIC FILM BAG STRUCTURE

TECHNICAL FIELD

The present invention is directed to the technical field of plastic film bags commonly used for storing or retaining various products and things. More particularly, the present invention is directed to an improved plastic film bag structure of the type including two separate selectively closeable bags.

BACKGROUND OF THE INVENTION

Plastic film bag structures of the type including two separate bags or compartments are today commonly used for retaining and storing various items and things. Typically, such bag structures are used for retaining two related items desired to be retained together but separate from one another. One application of these types of bag structures is in the medical field where it is desirable to retain a specimen and an identification information card in connection with that specimen together but separate from one another.

A bag structure of this character is shown and described in Huseman et al., U.S. Pat. No. 6,012,844. The bag structure of that patent includes front, middle, and rear plastic film panels attached to one another along their bottom and side edges thereby forming a first bag between the front and middle panels and a second bag between the middle and rear panels. An adhesive strip is provided between the middle and rear panels extending between terminal ends at the bag side edges and extending upwardly therefrom to a middle portion between the adhesive terminal ends. A release liner is also provided between the middle and rear panels over the adhesive strip middle portion thereby retaining the middle and rear panels detached from one another along the release liner and thereby also providing an opening leading to the second bag between the middle and rear panels. The adhesive strip is continuous between its terminal ends and, therefore, upon removal of the release liner from the adhesive strip, the middle and rear panels are attached to one another along the adhesive strip thereby rendering the second bag substantially leak resistant and essentially hermetically sealing the contents within the second bag.

The first bag of Huseman et al., U.S. Pat. No. 6,012,844 formed between the front and middle panels is open at its upper end. The middle panel is folded over at its top edge thereby providing a pocket generally vertically above the first bag and having an opening adjacent and above the opening leading to the first bag. When used in the medical field, after a specimen has been placed and sealed in the second bag, the corresponding specimen identification sheet or card is placed in the front bag and with the upper portion of the identification card extending up and into the pocket there above.

Although bag structures of this character sufficiently achieve their intended purpose, they are not without drawbacks and short comings. For example, it is sometimes desirable to also seal the contents in the first bag such as the specimen identification card thereby preventing inadvertent loss or tampering prior to reaching the intended final destination. It is yet further preferable to also make the first bag substantially leak resistant for thereby essentially hermetically sealing the specimen identification card or other contents therein and helping prevent potential contamination thereof from the specimen or contents in the second bag or from the outside.

Accordingly, a need exists for a selectively closeable plastic film bag structure including two bags which are selectively closeable and preferably substantially leak resistant and, further, which can generally more easily, reliably, and inexpensively be manufactured.

SUMMARY OF THE INVENTION

A primary object of the present invention is to provide a new and improved selectively closeable plastic film bag structure which overcomes the above-discussed disadvantages and draw backs associated with prior selectively closeable plastic film bags.

The present invention is directed to a new and improved selectively closeable plastic film bag structure including front, middle and rear plastic film panels attached to one another preferably by heat sealing at their bottom and side edges thereby forming a first bag having a bottom and side edges between the front and middle panels and a second bag having a bottom and side edges between the middle and rear panels. A first adhesive strip is provided between the middle and rear panels and extends between terminal ends at each of the second bag side edges. The first adhesive strip includes a middle portion located above the terminal ends thereof. A release liner is provided between the middle and rear panels and over the adhesive strip middle portion thereby retaining the middle and rear panels detached from one another and providing an opening to the second bag between the middle and rear panels. The adhesive strip is continuous between its terminal ends so that when the release liner is removed, the middle and rear panels are attached to one another across the entire length of the adhesive strip and to the terminal ends and side edges of the second bag and, thereby, rendering the second bag substantially leak resistant when closed.

Both the front and rear panels extend above the middle panel and a second adhesive strip is provided above the middle panel and between the front and rear panels. Preferably, the same release liner as that extending over the first adhesive strip also extends over the second adhesive strip thereby retaining the front and rear panels detached from one another and providing an opening to the first bag between the first and middle panels. Upon detachment of the release liner from the second adhesive strip, the front and rear panels are attached to one another with the second adhesive strip for closing the first bag and any contents therein.

Preferably, the second adhesive strip extends between terminal ends at the first bag side edges and includes a middle portion located above the second adhesive strip terminal ends and the release liner thereof is located over the second adhesive strip middle portion. Accordingly, when the release liner is removed, not only is the second bag closed and substantially leak resistant, but, also, the first bag is closed and substantially leak resistant. This is because the second adhesive strip is also continuous and extends between its terminal ends at the first bag side edges, thereby causing the front and rear panels to be attached to one another along the adhesive strip across the entire length of the second adhesive strip between the second adhesive strip terminal ends and the first bag side edges.

More preferably, both the first and second adhesive strips are located on the rear panel and the middle portion of both the first and second adhesive strips are sandwiched between the release liner and the rear panel. The terminal ends of both the first and second adhesive strips extend below the release liner and to the bags side edges. The first adhesive strip terminal ends below the release liner are located between the middle and rear panels and extend out to the side edges of the middle and rear panels. The middle panel is notched at its side edges near the release liner thereby exposing the front panel to the rear panel at the notched areas. The second adhesive strip terminal ends below the release liner extend into the middle panel notched areas and to the side edges of the front and rear panels thereby directly attaching the rear panel to the front panel along the second adhesive strip and to the side edges of the front and rear panels.

It is yet further preferred to attach the front and middle panels to one another by heat sealing at side areas extending from the first bag or front and middle panels side edges inwardly toward the top edge of the middle panel and extending the second adhesive strip terminal ends to the side areas attachments. The side areas attachments between the front and middle panels are further preferably over the first adhesive strip terminal ends and leading to the first and second bag side edges. Accordingly, by attaching the front and middle panels at the side areas attachments and extending the second adhesive strip terminal ends thereto, upon detachment of the release liner, the front and rear panels are attached to one another with the second adhesive strip to the terminal ends thereof extending to the side areas attachments whereat the front and middle panels are attached to one another and thereby rendering the second bag substantially leak resistant. Yet more preferably, the front, middle, and rear panels and the release liner are cut away above the adhesive strips at the bags side edges thereby freeing the release liner from the front, middle and rear panels in the event any adhesion occurred during the heat sealing of the side edges.

In one form thereof, the present invention is directed to an improvement in a selectively closeable plastic film bag structure including front, middle and rear plastic film panels forming a first bag having a bottom and side edges between the front and middle panels and a second bag having a bottom and side edges between the middle and rear panels. An adhesive strip is provided between the middle and rear panels extending between terminal ends at the second bag side edges and having a middle portion located above the terminal ends A release liner is provided between the middle and rear panels and over the adhesive strip middle portion. The middle and rear panels remain detached and an opening is provided to the second bag whereby, upon detachment of the release liner from the adhesive strip, the middle and rear panels are attached to one another with the adhesive middle portion. The improvement includes extending the front panel above the middle panel and providing a second adhesive strip above the middle panel and between the front and rear panels A release liner is located over the second adhesive strip whereby the front and rear panels remain detached and an opening is provided to the first bag. Upon detachment of the release liner from the second adhesive strip, the front and rear panels are attached to one another with the second adhesive strip.

In one form thereof, the present invention is directed to a selectively closeable plastic film bag structure including front, middle and rear plastic film panels forming a first bag having a bottom and side edges between the front and middle panels and a second bag having a bottom and side edges between the middle and rear panels. An adhesive strip is provided between the middle and rear panels and extends between terminal ends at the second bag side edges and has a middle portion located above the terminal ends. A release liner is provided between the middle and rear panels and over the adhesive strip middle portion whereby the middle and rear panels remain detached and an opening is provided to the second bag. The front panel extends above the middle panel and a second adhesive strip is provided above the middle panel and between the front and rear panels. The release liner extends over the second adhesive strip whereby the front and rear panels remain detached and an opening is provided to the first bag. Upon detachment of the release liner from the first and second adhesive strips, the front and rear panels are attached to one another with the second adhesive strip and the middle and rear panels are attached to one another with the first adhesive strip.

BRIEF DESCRIPTION OF THE DRAWINGS

The above-mentioned and other features and objects of this invention and the manner of obtaining them will become more apparent and the invention itself will be better understood by reference to the following description of embodiments of the invention taken in conjunction with the accompanying drawings wherein.

Figure 2:
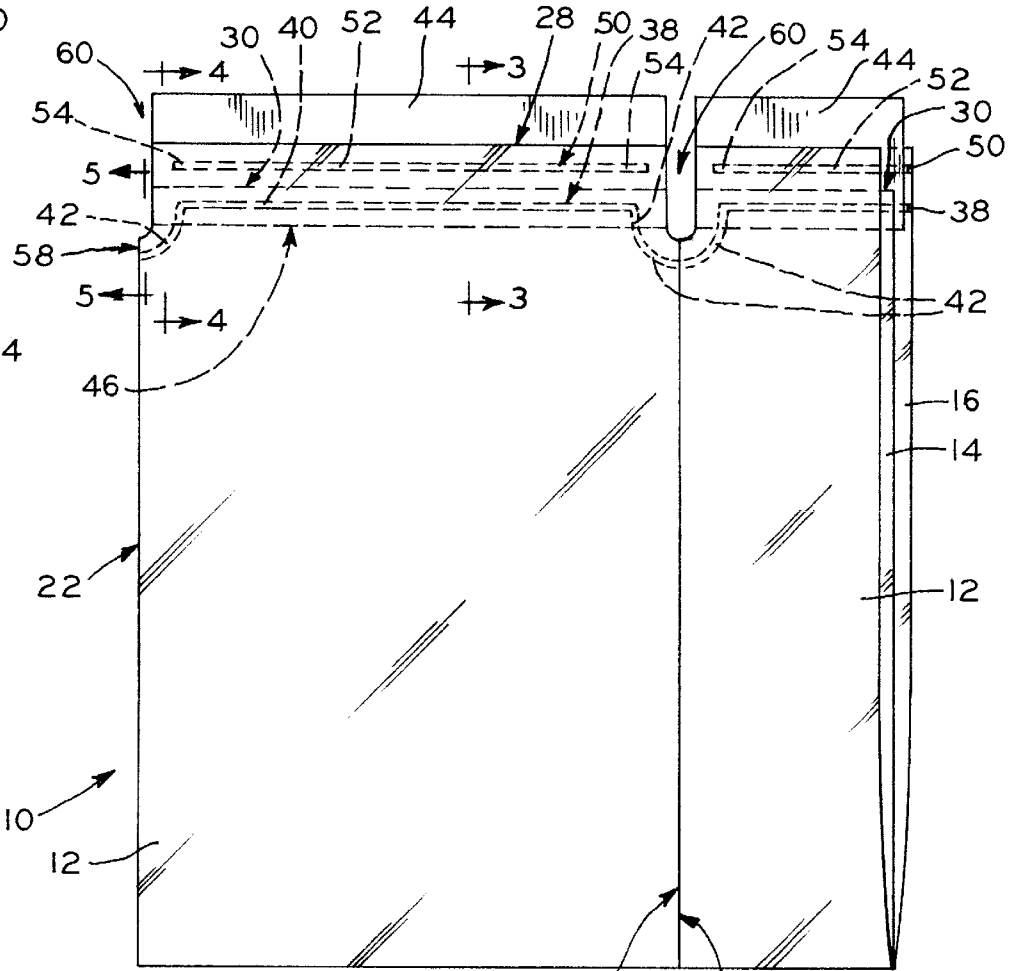
FIG. 2 is a front elevation view of the bag structure shown in FIG. 1 and showing the bag structure as would be manufactured with an adjacent similar bag structure.
Figure 1:
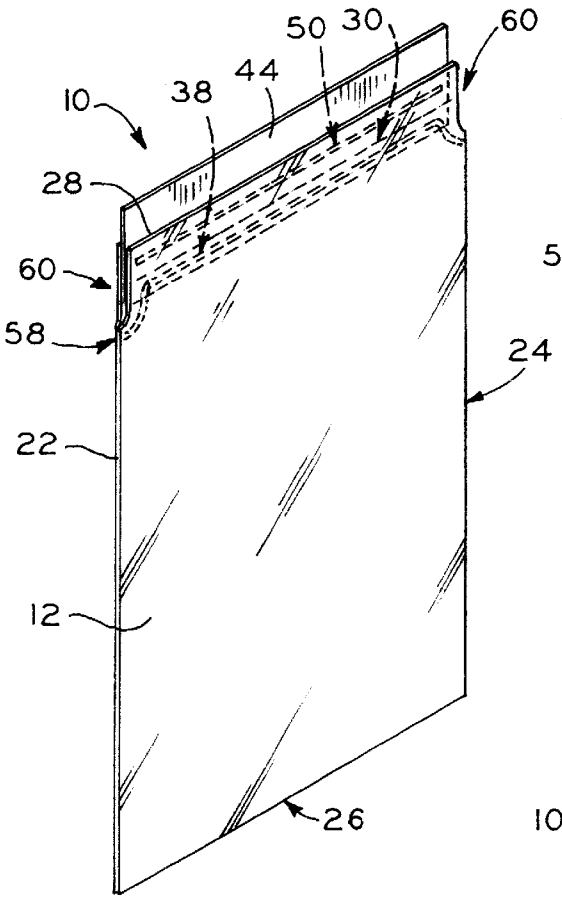
FIG. 1 is a perspective view of a selectively closeable plastic film bag structure constructed in accordance with the principles of the present invention.

Corresponding reference characters indicate corresponding parts throughout the several views of the drawings The exemplifications set out herein illustrate preferred embodiments of the invention in one form thereof and such exemplifications are not to be construed as limiting the scope of the disclosure or the scope of the invention in any manner

DETAILED DESCRIPTION OF THE PREFERRED EMBODIMENTS

Referring initially to FIGS. 1–6, there is shown a selectively closeable plastic film bag structure generally designated by the numeral 10 and constructed in accordance with the principles of the present invention. Bag structure 10 is made up of and includes a front panel or wall of plastic film 12, a middle panel or wall plastic film 14 and a rear panel or wall plastic film 16. Panels 12, 14 and 16 are preferably made of polyethylene or a synthetic resin suitable for forming such bags and is generally translucent. Panels 12, 14 and 16 each include and are joined together at left side edge 22, right side edge 24 and bottom edge 26 thereby forming a first bag or cavity 18 between the front panel 12 and middle panel 14 and a second bag or cavity 20 between the middle panel 14 and the rear panel 16. Panels 12, 14 and 16 are attached to one another at side edges 22 and 24 and bottom edge 26 by heat sealing as depicted at the bottom edge 26 shown in FIG. 6 between panels 12 and 14, or folded over from a single sheet as depicted also at the bottom edge 26 shown in FIG. 6 between panels 14 and 16 In any event, panels 12, 14 and 16 are attached at their left side edge 22, right side edge 24 and bottom edge 26 continuously and so as to be substantially leak resistant.

At their upper end, front panel 12 includes a top edge 28, middle panel 14 includes a top edge 30 and rear panel 16 includes a top edge 32. As more fully discussed herein below, panels 12, 14 and 16 are retained detached from one another at their upper ends thereby providing an opening 34 between panels 12 and 14 leading to bag 18 and an opening 36 between panels 14 and 16 leading to bag 20. Products and other items and things can, therefore, be placed into bags 18 and 20 through respective openings 34 and 36.

A lower adhesive strip 38 is provided on the inside surface of rear panel 16 and includes a middle portion 40 and terminal ends 42. As shown in FIG. 2, the middle portion 40 preferably extends horizontally generally parallel with the top edges 28, 30 and 32 and the terminal ends 42 thereof extend downwardly therefrom and out towards and to the left and right side edges 22 and 24. Adhesive strip 38 is applied continuously or uninterrupted between the side edges 20 and 24 The adhesive strip is preferably made of a tacky, generally pliable material such as a hot melt adhesive available from National Starch and Chemical and which readily adheres to the surfaces of polyethylene plastic film.

A release liner 44 made of, for example, silicon covered or coated plastic film or paper is applied onto or over the adhesive strip 38. Preferably as shown, the bottom edge 46 of the release liner 44 extends below the middle portion 40 of the adhesive strip 38 but above at least at a portion of the adhesive strip terminal ends 42 as shown in FIG. 2. Accordingly, the adhesive strip terminal ends 42 located below the release liner bottom edge 46 are exposed to and are in contact with to both the middle panel 14 and rear panel 16 thereby adhering or attaching together the middle panel 14 and rear panel 16 from the release liner bottom edge 46 to the bag 20 side edges 22 and 24. However, the adhesive strip 38 located above the release liner bottom edge 46 is prevented from coming in contact with the inner surface of middle panel 14 and, therefore, bag 20 is retained open and is accessible through opening 36 thereof. Release liner 44 does not stick or adhere to the adhesive strip 38 but is retained thereat and is essentially detachably attachable to the adhesive strip 38. Thus, after placing an item such as a test tube 48 within bag 20, the release liner 44 is detached and removed from between middle and rear panels 14 and 16, the remaining part of adhesive strip 38 is allowed to come in contact with the inside surface of middle panel 14 and, thereby, providing a continuous substantially leak resistant seal for bag 20 between left and right side edges 22 and 24 along adhesive strip 38

Figure 3:
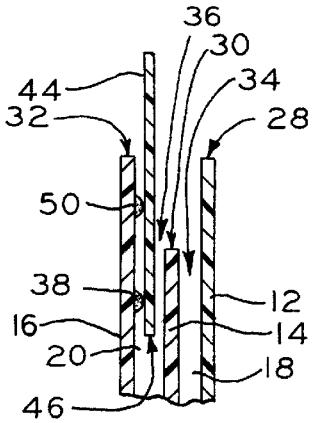
FIG. 3 is a cross sectional view of the bag structure shown in FIG. 2 taken generally along line 3—3.
Figure 4:
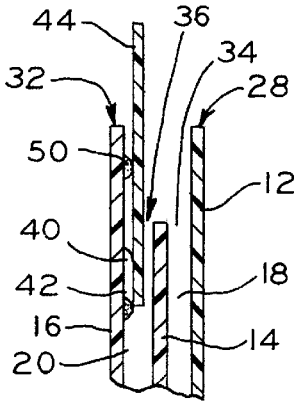
FIG. 4 is a cross sectional view of the bag structure shown in FIG. 2 and taken generally along line 4—4.
Figure 5:
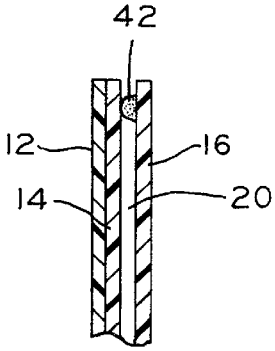
FIG. 5 is a cross sectional view of the bag structure shown in FIG. 2 and taken generally along line 5—5.
Figure 6:
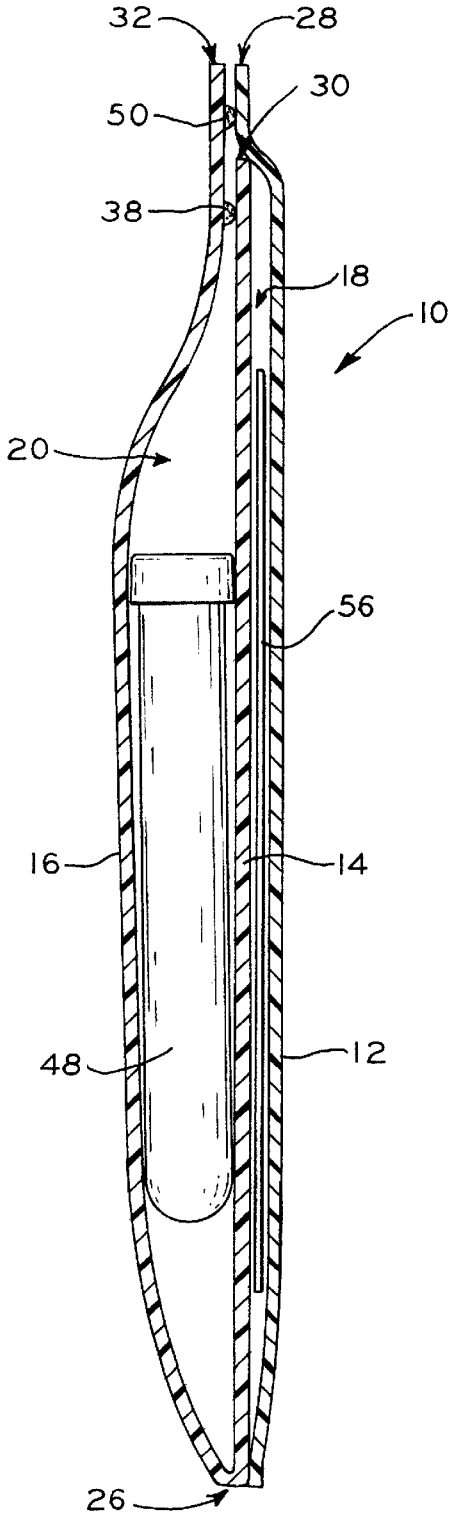
FIG. 6 is a cross sectional view of the bag structure shown in FIG. 1 after product has been placed therein and the release liner removed.
Figure 8:
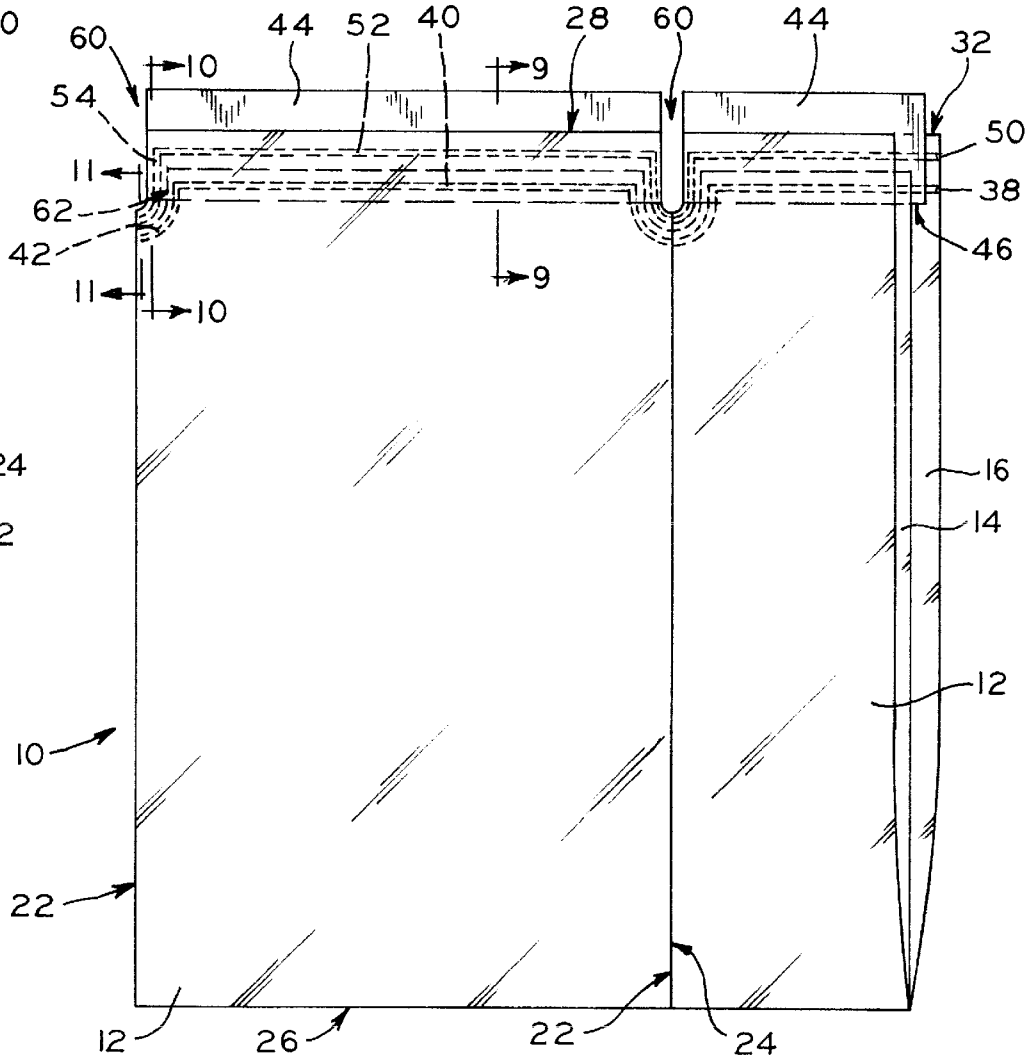
FIG. 8 is a front elevation view of the bag structure shown in FIG. 7.
Figure 7:
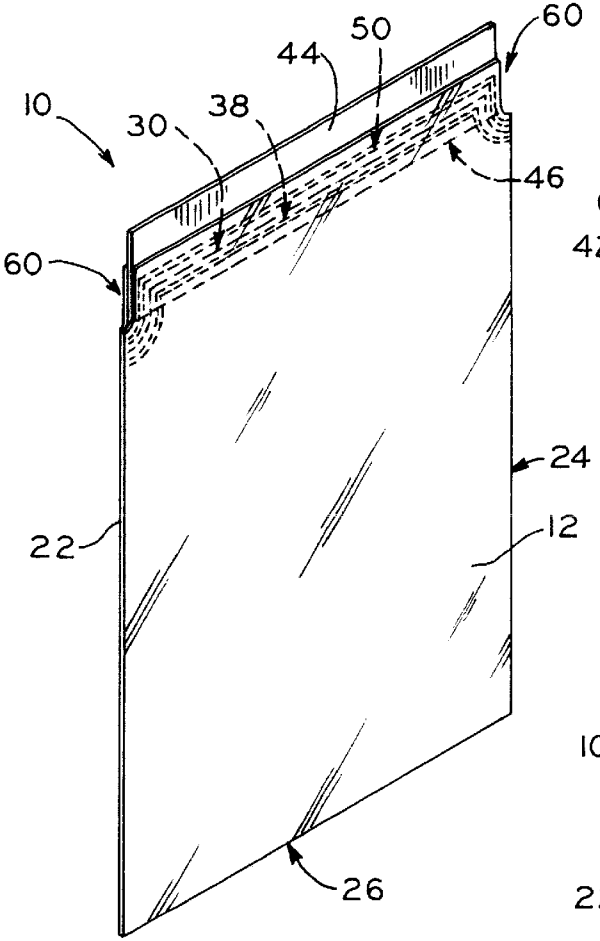
FIG. 7 is a perspective view of another embodiment of a selectively closeable bag structure constructed in accordance with the principles of the present invention.
Figure 9:
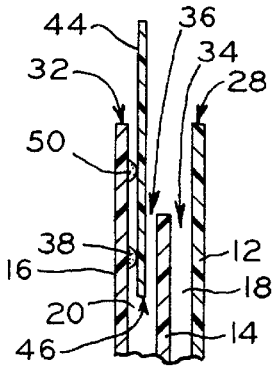
FIG. 9 is a cross sectional view of the bag structure shown in FIG. 8 and taken generally along line 9—9.
Figure 12:
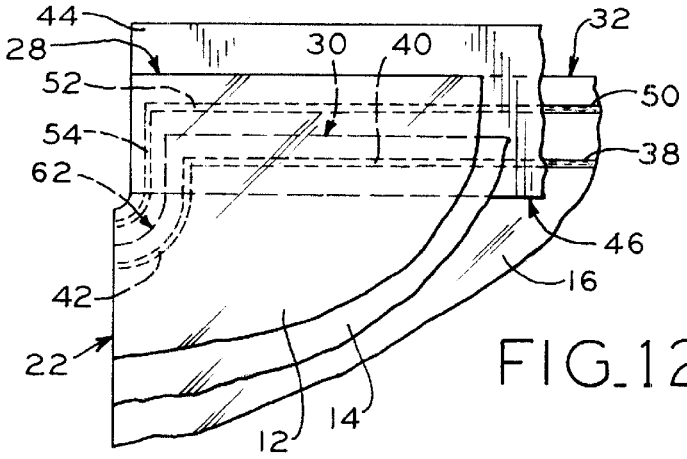
FIG. 12 is a partial cut-away view of the bag structure shown in FIG. 7 and depicting the various layers thereof.
Figure 10:
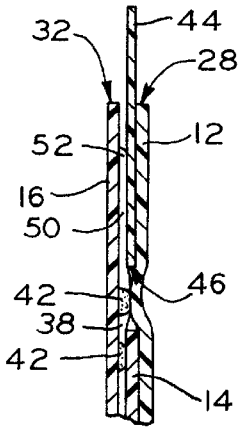
FIG. 10 is a cross sectional view of the bag structure shown in FIG. 8 and taken generally along line 10—10.
Figure 11:
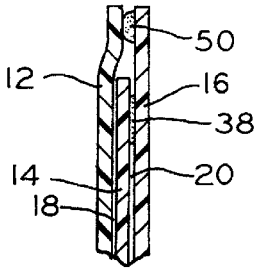
FIG. 11 is a cross sectional view of the bag structure shown in FIG. 8 and taken generally along line 11—11.

As best seen in FIGS. 3 and 6, the top edges 28 and 32 of front and rear panels 12 and 16 respectively extend vertically above the top edge 30 of middle panel 14. Further, an upper adhesive strip 50 is provided above the lower adhesive strip 38. The top edge 30 of middle panel 14 extends to a position above the lower adhesive strip 38 but below the upper adhesive strip 50. Upper adhesive strip 50 is preferably made of the same material as adhesive strip 38 and is applied to the inside surface of rear panel 16 Further, the same release liner 44 also preferably extends over the upper adhesive strip 50 thereby essentially sandwiching both adhesive strips 38 and 50 between the release liner 44 and the rear panel 16. Release liner 44 is thus detachably attachable to both of the adhesive strips 38 and 50 and, further, extends above the top edges 28 and 32 of front and rear panels 12 and 16 respectively for selectively grasping and detaching from the adhesive strips 38 and 50 and removing from between the panels 12, 14 and 16.

It is noted that the bag structure 10 is made by continuously traveling webs of plastic film traveling from left to right as shown in FIG. 2. Adhesive strips 38 and 50 are placed on the inside surface of the rear panel 16 and the release liner 44 is placed there over as the film travels longitudinally. Thereafter, the individual bag structures 10 are severed and simultaneously heat-sealed at the bag structure's side edges 22 and 24. During this process, it is possible to also fuse or seal the release liner 44 to the side edges 22 and 24 of each bag structure. Accordingly, panels 12, 14 and 16 as well as adhesive strip 44 are cut away or notched as indicated by the numeral 60 along the side edges 22 and 24 to below the bottom edge 46 of release liner 44. In this manner, release liner 44 is prevented from inadvertently adhering or otherwise becoming fused to the panels 12, 14 and 16 and, therefore, release liner 44 is retained in position only by the detachable attachment to adhesive strips 38 and 50 and can be easily detached and removed therefrom when so desired.

Upper adhesive strip 50 includes a middle portion 52 and terminal ends 54. Preferably, upper adhesive strip 50 extends generally parallel with the lower adhesive strip 38 and the terminal ends 54 extend to a position generally near the left and right side edges 22 and 24. When using the bag structure 10, for example, after placing a test tube 48 in bag 20 and a corresponding identification card 56 in the bag 18, the release liner 44 is detached from upper and lower adhesive strips 38 and 50 and removed from the position shown in FIG. 3. Accordingly, the lower adhesive strip 38 comes in contact with the inner surface of the middle panel 14 thereby closing bag 20, and the upper adhesive strip 50 comes in contact with the inner surface of front panel 12 thereby closing bag 18 as best shown in FIG. 6. As can be appreciated, in this embodiment, although bag 20 is substantially leak resistant, bag 18 is not. That is, although adhesive strip 50 is preferably continuous as shown, there remain openings leading to bag 18 from terminal ends 54 to respective upper ends 58 of side edges 22 and 24 whereat the front, middle and rear panels 12, 14 and 16 are attached to one another. Thus, although bag 18 is closed, it is not leak resistant Referring now more particularly to FIGS. 7–12, there is shown an embodiment constructed in accordance with the principles of the present invention and wherein the first bag 18 is also substantially leak resistant in this embodiment, a portion of the terminal ends 42 of the lower adhesive strip 38 extend below the bottom edge 46 of release liner 44 and to the side edges 22 and 24 The middle panel 14 is further provided with a notch or cut out at its side edges upwardly to the top edge 30 of middle panel 14. More particularly, notch or cut out 62 is provided in the middle panel 14 from the middle panel side edge 22 above the terminal end 42 of lower adhesive strip 38 and to the upper edge 30 of middle panel 14. The terminal ends 54 of upper adhesive strip 50 are then extended into the notched area 62 and to the side edges 22 and 24. More specifically, the terminal ends 54 of adhesive strip 50 are preferably extended to below the bottom edge 46 of release liner 44 and to the side edges 22 and 24 of bags 18 and 20. The adhesive strip 50 thus extends between the side edges 22 and 24 continuously through the terminal ends 54 and the middle portion 52 along the inner surface of the rear panel 16.

As should now be appreciated, because of notches 62 in the middle panel 14, the portion of terminal ends 54 of adhesive strip 50 below the bottom edge 46 of release liner 44 comes in contact with both the inner surfaces of front panel 12 and rear panel 16 thereby sealing the front and rear panels together from below the bottom edge 46 of release liner 44 to the side edges 22 and 24 of bag 18. The release liner extending over the adhesive strip 50 retains the front and rear panels 12 and 16 detached from one another thereby providing an opening 34 leading to the bag 18. However, upon detachment and removal of the release liner 44, in addition to the closure of bag 20 as described herein above, the front and rear panels 12 and 16 are attached to one another with the upper adhesive strip 50 along their inner surface and between side edges 22 and 24. Accordingly, a substantially leak resistant closure is provided between the front and rear panels 12 and 16 along the upper adhesive strip 50 from side edge 22 to side edge 24 and, thereby, rendering bag 18 substantially leak resistant. It should further be noted that although the upper edge 30 of the middle panel 14 terminates below the upper adhesive strip 50 and within the bag 20, because the middle and rear panels 14 and 16 are closed in a substantially leak resistant manner along adhesive strip 38, bags 18 and 20 are also sealed and substantially leak resistant from one another.

Figure 15:
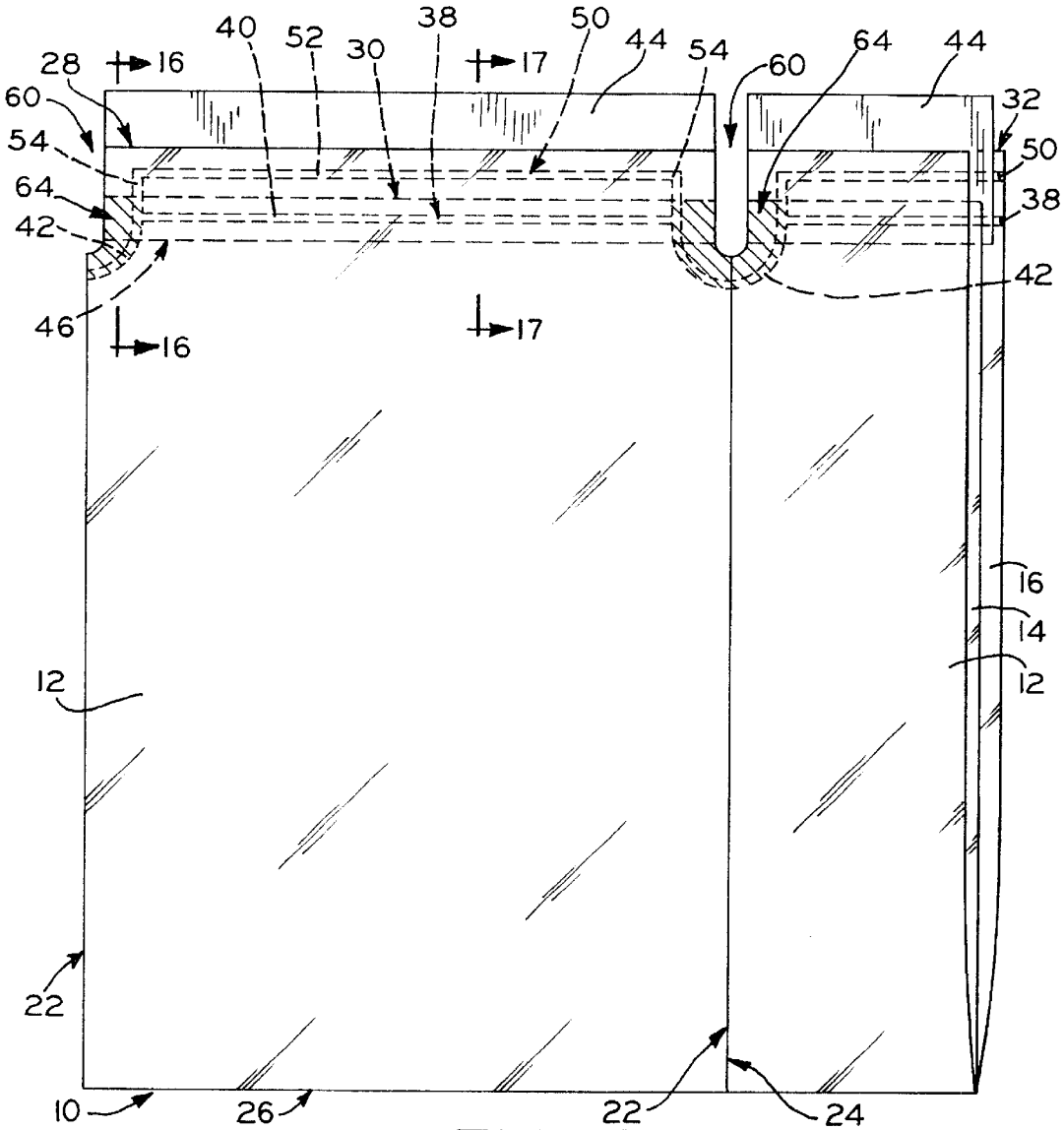
FIG. 15 is a front elevation view of another embodiment of a selectively closeable bag structure constructed in accordance with the principles of the present invention.
Figure 16:
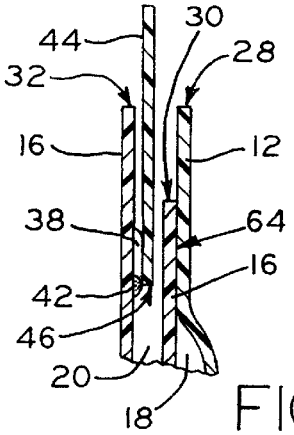
FIG. 16 is a cross sectional view of the bag structure shown in FIG. 15 and taken generally along line 16—16; and, FIG. 17 is a cross sectional view of the bag structure shown in FIG. 15 and taken generally along line 17—17.
Figure 17:
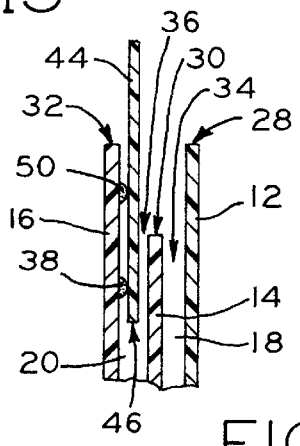

Referring now more particularly to FIGS. 15–17, there is shown another embodiment of the bag structure 10 constructed in accordance with the principles of the present invention and wherein bag 18 is also substantially leak resistant. In this embodiment, the middle panel is not provided with a notch 62 and the front, middle and rear panels 12, 14 and 16 are shaped similar to that of the embodiment of FIGS. 1–6. Here, however, the front and middle panels 12 and 14 are attached to one another at side areas 64 shown in FIG. 15 with cross hatching lines. Front and middle panels 12 and 14 are preferably attached to one another by heat sealing or other suitable means at side areas 64. More particularly, the surfaces between the front and middle panels 12 and 14 depicted in FIG. 15 by the cross hatch lines are attached to one another. As shown, side areas 64 preferably extend from the top edge 30 of middle panel 14 to the side edges 22 and 24 of the bag 18 and over the terminal ends 42 of lower adhesive strip 38. Terminal ends 54 of the upper adhesive strip 50 extend to the side areas 64 and preferably to the lower adhesive strip 38 as shown. Accordingly, in this embodiment, because the front and middle panels 12 and 14 are attached to one another at side areas 64 and release liner 44 extends over the upper adhesive strip 50, the bag 18 is retained open at opening 34 between the side areas 64 and along upper adhesive strip 50 which is covered or sandwiched between the release liner 44 and the rear panel 16. However, upon detachment of the release liner 44 from the lower and upper adhesive strips 38 and 50 and removal from between the panels, the rear panel 16 is attached to the front panel 12 along their inside surfaces and along the upper adhesive strip 50 between its terminal ends 54 adjacent the upper edge 30 of middle panel 14 Because upper adhesive strip 50 extends continuously between its terminal ends 54, a substantially leak resistant seal is provided there along between the front and rear panels 12 and 16 and extending to the upper edge 30 of middle panel 14. Further, because the front and middle sheets 12 and 14 are attached and sealed together below the middle panel top edge 30 at side areas 64 extending to the side edges 22 and 24, the first bag 18 is also sealed between the middle panel upper edge 30 and side edges 22 and 24 and, therefore, bag 18 is also substantially leak resistant.

Figure 13:
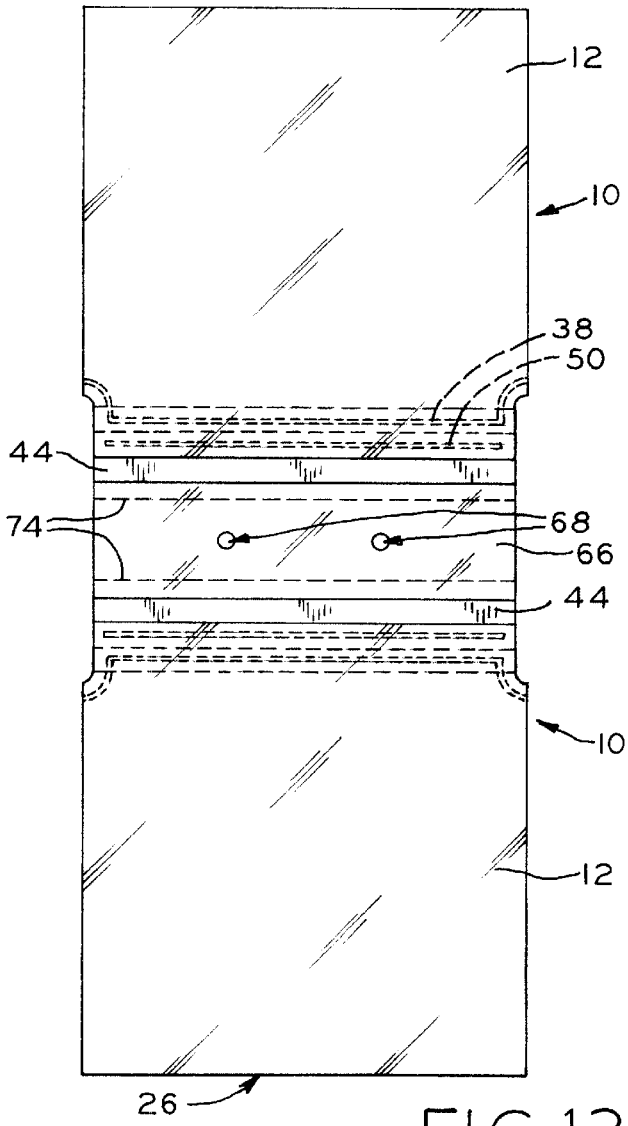
FIG. 13 is a top plan view of a selectively closeable plastic film bag structure constructed in accordance with the principles of the present invention and in a saddle bag structure.
Figure 14:
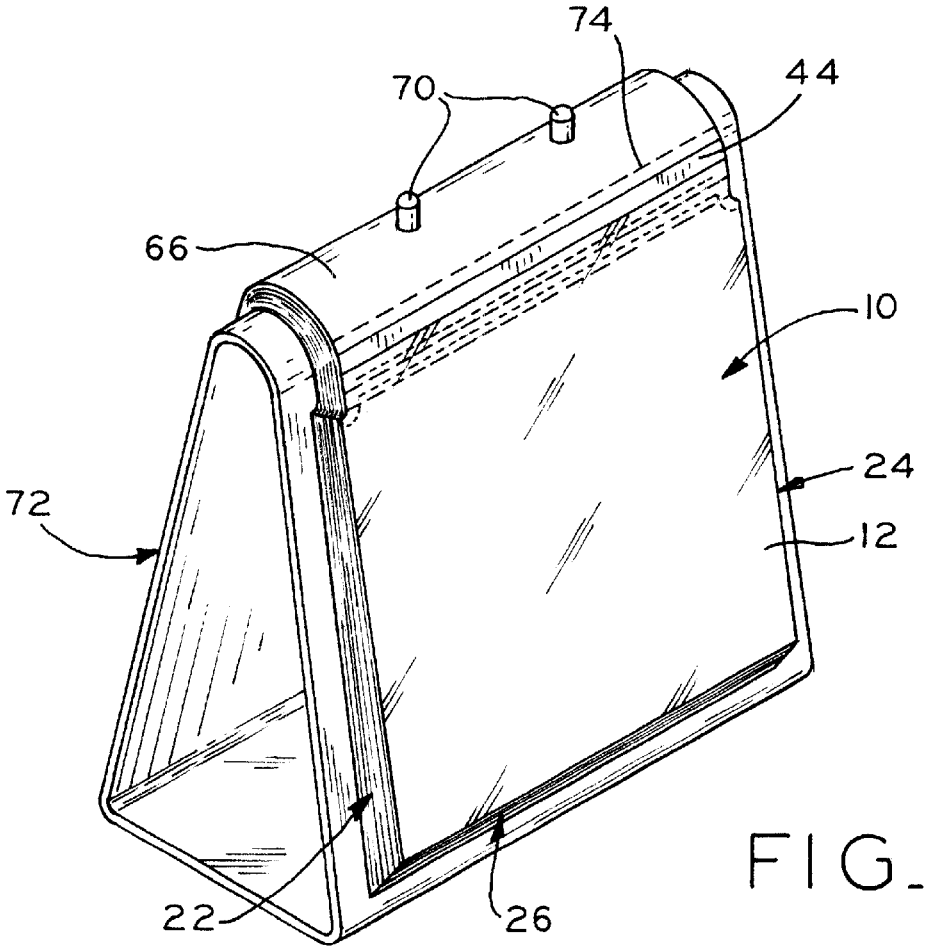
FIG. 14 is a perspective view of the selectively closeable bags shown in FIG. 13 on an A-frame as would be available for use.

Referring now to FIGS. 13 and 14, it is noted that the bag structure 10 is preferably manufactured in a saddle bag type structure including a header 66 between bag structures 10 on either side thereof. Holes 68 are provided on header 66 for receiving pegs 70 when the bags are placed over an A-frame structure 72 as shown in FIG. 14. As can be appreciated, in this position, the openings 34 and 36 leading to bags 18 and 20 respectively of each bag structure 10 are easily accessible for placement of products and things therein and, thereafter, removal of the release liner for closing the bags 18 and 20. Perforation lines 74 are provided on the headers 66 whereby each of the bag structures 10 can selectively be separated from its header 66 and individually dispensed as needed.

While the invention has been described as having specific embodiments, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims

What is claimed is:

1. An improvement in a selectively closeable plastic film bag structure including front, middle and rear plastic film panels forming a first bag having a bottom and side edges between the front and middle panels and a second bag having a bottom and side edges between the middle and rear panels, an adhesive strip between the middle and rear panels extending between terminal ends at the second bag side edges and having a middle portion located above the terminal ends, a release liner between the middle and rear panels and over the adhesive strip middle portion, whereby the middle and rear panels remain detached and an opening is provided to the second bag and whereby, upon detachment of the release liner from the adhesive strip, the middle and rear panels are attached to one another with the adhesive middle portion, the improvement comprising:

the front panel extending above the middle panel;

a second adhesive strip above the middle panel and between the front and rear panels; and, a release liner located over the second adhesive strip, whereby the front and rear panels remain detached and an opening is provided to the first bag and whereby, upon detachment of the release liner thereof from the second adhesive strip, the front and rear panels are attached to one another with the second adhesive strip.

2. The improvement of claim 1 wherein the second adhesive strip extends between terminal ends at the first bag side edges and includes a middle portion located above the second adhesive strip terminal ends, the release liner thereof located over the second adhesive strip middle portion.

3. The improvement of claim 2 wherein the second adhesive strip is on the rear panel and the middle portion thereof is sandwiched between the release liner thereof and the rear panel.

4. The improvement of claim 3 wherein the second adhesive strip terminal ends are located below the release liner thereof.

5. The improvement of claim 4 wherein the middle panel is notched a its side edges and the second adhesive terminal ends extend into the middle panel notches.

6. The improvement of claim 5 wherein the same release liner extends over both the first and second adhesive strip middle potions.

7. The improvement of claim 6 wherein the front, middle, and rear panels and the release liner are cut away above the adhesive strips at the bags side edges.

8. The improvement of claim 3 wherein the same release liner extends over both the first and second adhesive strip middle potions.

9. The improvement of claim 2 wherein the second adhesive strip terminal ends are located below the release liner thereof.

10. The improvement of claim 9 wherein the middle panel is notched a its side edges and the second adhesive terminal ends extend into the middle panel notches.

11. The improvement of claim 10 wherein the same release liner extends over both the first and second adhesive strip middle potions.

12. The improvement of claim 2 wherein the same release liner extends over both the first and second adhesive strip middle potions.

13. The improvement of claim 2 wherein the middle panel is notched a its side edges and the second adhesive terminal ends extend into the middle panel notches.

14. The improvement of claim 13 wherein the same release liner extends over both the first and second adhesive strip middle potions.

15. The improvement of claim 1 wherein the second adhesive strip is on the rear panel and is sandwiched between the release thereof and the rear panel.

16. The improvement of claim 15 wherein the same release liner extends over both the first and second adhesive strips.

17. The improvement of claim 1 wherein the same release liner extends over both the first and second adhesive strips.

18. The improvement of claim 1 wherein the front, middle, and rear panels and the release liner are cut away above the adhesive strips at the bags side edges.

19. The improvement of claim 1 wherein the front and middle panels are attached to one another at side areas generally over the first adhesive strip terminal ends.

20. The improvement of claim 19 wherein the second adhesive strip extends between terminal ends extending to the side areas.

21. The improvement of claim 20 wherein the second adhesive strip is on the rear panel and is sandwiched between the release liner thereof and the rear panel.

22. The improvement of claim 21 wherein the same release liner extends over both the first and second adhesive strips.

23. The improvement of claim 22 wherein the front, middle, and rear panels and the release liner are cut away above the adhesive strips at the bags side edges.

24. The improvement of claim 19 wherein the same release liner extends over both the first and second adhesive strips.

25. The improvement of claim 19 wherein the side areas attachments are by heat sealing.

26. The improvement of claim 1 wherein the front and middle panels are attached to one another at side areas, the second adhesive strip extends between terminal ends extending between a middle portion, and wherein the second adhesive strip terminal ends extend to the side areas attachments.

27. The improvement of claim 26 wherein the second adhesive strip is on the rear panel and the middle portion thereof is sandwiched between the release liner thereof and the rear panel.

28. The improvement of claim 27 wherein the same release liner extends over both the first and second adhesive strip middle portions.

29. The improvement of claim 28 wherein the front, middle, and rear panels and the release liner are cut away above the adhesive strips at the bags side edges.

30. The improvement of claim 26 wherein the same release liner extends over both the first and second adhesive strip middle portions.

31. The improvement of claim 26 wherein the side areas attachments are by heat sealing.

32. The improvement of claim 31 wherein the same release liner extends over both the first and second adhesive strip middle portions.

33. An improvement in a selectively closeable plastic film bag structure including front, middle and rear plastic film panels forming a first bag having a bottom and side edges between the front and middle panels and a second bag having a bottom and side edges between the middle and rear panels, an adhesive strip between the middle and rear panels extending between terminal ends at the second bag side edges and having a middle portion located above the terminal ends, a release liner between the middle and rear panels and over the adhesive strip middle portion, whereby the middle and rear panels remain detached and an opening is provided to the second bag and whereby, upon detachment of the release liner from the adhesive strip, the middle and rear panels are attached to one another with the adhesive middle portion, the improvement comprising:

means for retaining open and selectively closing the second bag.

34. A selectively closeable plastic film bag structure comprising:

front, middle and rear plastic film panels forming a first bag having a bottom and side edges between said front and middle panels and a second bag having a bottom and side edges between said middle and rear panels;

a first adhesive strip between said middle and rear panels extending between terminal ends at said second bag side edges and having a middle portion located above said terminal ends;

a release liner between said middle and rear panels and over said first adhesive strip middle portion, whereby said middle and rear panels remain detached and an opening is provided to said second bag;

said front panel extending above said middle panel;

a second adhesive strip above said middle panel and between said front and rear panels; and, said release liner extending over said second adhesive strip, whereby said front and rear panels remain detached and an opening is provided to said first bag and whereby, upon detachment of said release liner from said first and second adhesive strips, said front and rear panels are attached to one another with said second adhesive strip, and said middle and rear panels are attached to one another with said first adhesive strip.

* * * * *

UNITED STATES PATENT AND TRADEMARK OFFICE

CERTIFICATE OF CORRECTION

PATENT NO. : 6,575,627 B2
DATED : June 10, 2003
INVENTOR(S) : David C. Huseman

It is certified that error appears in the above-identified patent and that said Letters Patent is hereby corrected as shown below:

Column 7,
Line 37, insert -- . -- after “resistant”.
Line 45, insert -- . -- after “24”.

Signed and Sealed this

Twelfth Day of August, 2003

JAMES E. ROGAN
*Director of the United States Patent and Trademark Office*